US007238896B2

(12) United States Patent
Nakayama et al.

(10) Patent No.: US 7,238,896 B2
(45) Date of Patent: Jul. 3, 2007

(54) SWITCH DEVICE

(75) Inventors: Daihei Nakayama, Fukushima-ken (JP); Masahiro Takata, Fukushima-ken (JP); Takashi Kondo, Fukushima-ken (JP); Yasuji Hagiwara, Fukushima-ken (JP); Kazunori Nakano, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/389,365

(22) Filed: Mar. 23, 2006

(65) Prior Publication Data

US 2006/0219533 A1 Oct. 5, 2006

(30) Foreign Application Priority Data

Apr. 5, 2005 (JP) ..... 2005-108831

(51) Int. Cl.
*H01H 9/30* (2006.01)

(52) U.S. Cl. ..... 200/10; 200/314

(58) Field of Classification Search ..... 200/310–314, 200/512–520, 10

See application file for complete search history.

(56) References Cited

U.S. PATENT DOCUMENTS 5,561,278 A * 10/1996 Rutten ..... 200/5 A
5,669,486 A * 9/1997 Shima ..... 200/314
6,446,654 B1 * 9/2002 Brazier et al. ..... 137/68.18
6,858,811 B2 * 2/2005 Fitzgerald et al. ..... 200/85 R
6,995,324 B2 * 2/2006 Asada ..... 200/1 B

FOREIGN PATENT DOCUMENTS

JP 48-99462 2/1947

* cited by examiner

*Primary Examiner*—Michael A Friedhofer
*Assistant Examiner*—Lisa Klaus
(74) *Attorney, Agent, or Firm*—Brinks Hofer Gilson & Lione

(57) ABSTRACT

A switch device is provided that includes a first switch portion in which an upper electrode and lower electrodes face each other at a predetermined gap and a second switch portion having metal domes which are disposed at a lower side facing the first switch portion and expand to a predetermined height. A first spacer having a predetermined thickness A is disposed in the first switch portion to form a gap between the upper electrode and the lower electrodes, a second spacer having a thickness B equal to or greater than the expanded height of the metal domes is disposed in the second switch portion, and the thickness of the second spacer is greater than that of the first spacer.

5 Claims, 3 Drawing Sheets

SWITCH DEVICE

BACKGROUND OF THE INVENTION

1. Field of the Invention

The present invention relates to a switch device, and more particularly, to a switch device for pressing a first switch portion and a second switch portion to the same press position to operate the both switch portions.

2. Description of the Related Art

A conventional switch device will be described with reference to Patent Document 1. As illustrated in FIG. 5, in the conventional switch device 20, a cover 21 made of a rubber plate is positioned at an uppermost portion thereof and an operation portion 21*a* is formed on the cover 21.

A first flexible printed board 22 is disposed under the cover 21 and a first common electrode 23 is formed under the first printed board 22.

The first printed board 22 is disposed on a first spacer 24 having a predetermined thickness and a first through-hole 24*a* which has the first common electrode 23 can be bent downward is formed in the first spacer 24.

In addition, a second flexible printed board 25 is disposed under the first spacer 24 and a pair of first individual electrodes 26 and 26 which are insulated from each other is formed at a position facing the first common electrode 23 on the second printed board 25 at a predetermined gap from the first common electrode 23.

Moreover, a first switch portion is composed of the first common electrode 23 and the first individual electrodes 26 and 26.

Furthermore, a second common electrode 27 is formed under the second printed board 25 and the second printed board 25 is disposed on the second spacer 28.

A second through-hole 28*a* which has the second common electrode 27 and can be elastically deformed downward is formed in the second spacer 28.

In addition, a third flexible printed board 29 is formed under the second spacer 28 and a pair of second individual electrodes 30 and 30 which are insulated from each other is formed at a position facing the second common electrode 27 on the third printed board 29 at a predetermined gap from the second common electrode 27.

Furthermore, a second switch portion is composed of the second common electrode 27 and the second individual electrodes 30 and 30.

Now, an operation of the conventional switch device 20 will be described. First, the cover 21 is bent downward by a first operation for slightly pressing the operation portion 21*a* using an operator's finger.

Accordingly, the first common electrode 23 is displaced downward and comes into contact with the pair of first individual electrodes 26 and 26.

The first individual electrodes 26 and 26 are electrically conducted to each other through the first common electrode 23 to turn on the first switch portion.

After the first operation, the cover 21 is more bent downward by a second operation for strongly pressing the operation portion 21*a*, compared with the first operation, and the second printed board 25 is pressed downward to be bent downward in the state that the first switch portion is turned on.

Accordingly, the second common electrode 27 is displaced downward and comes into contact with the pair of the second individual electrodes 30 and 30. Then, the second individual electrodes 30 and 30 are electrically conducted to each other through the second common electrode 27 to turn on the second switch portion.

In the conventional switch device 20, it is possible to turn on the first and second switch portions by the first operation for slightly touching the operation portion 21*a* and the second operation for more strongly pressing the operation portion 21*a* than the first operation after the first operation.

[Patent Document 1] Japanese Examined Utility Model Registration Application Publication No. 48-99462

However, in the conventional switch device 20, since the thicknesses of the first and second spacer 24 and 28 are equal to each other, when the operator turns on the first switch portion by the first operation of the operation portion 21*a*, the second printed board 25 may be also pressed to turn on the second switch portion.

In other words, the second operation for turning on the second switch portion may be performed by the first operation for turning on only the first switch portion, thereby generating an incorrect input.

SUMMARY OF THE INVENTION

In order to solve the above-mentioned problems, an object of the present invention is to provide a switch device having excellent operability, which is capable of turning on only a first switch portion by a first operation, without turning on a second switch portion.

According to a first aspect of the present invention, there is provided a switch device including a first switch portion in which an upper electrode and a lower electrode face each other at a predetermined gap and a second switch portion having metal domes which are disposed at a lower side facing the first switch portion and expand to a predetermined height, wherein a first spacer having a predetermined thickness is disposed in the first switch portion to form a gap between the upper electrode and the lower electrode, a second spacer having a thickness equal to or greater than the expanded height of the metal domes is disposed in the second switch portion, and the thickness of the second spacer is greater than that of the first spacer.

Moreover, an upper sheet on which the upper electrode is formed and a lower sheet on which the lower electrode is formed may be disposed to face each other through the first spacer, a plurality of through-holes which are defined by grid-shaped trapezoidal portions and receive the metal domes may be formed in the second spacer, and ridge lines of sides of the trapezoidal portions, on which the lower sheet is mounted, may be chamfered or rounded.

In addition, operation pieces which can press the metal domes received in the through-holes may be supported in the trapezoidal portions in a cantilever type or in a center impeller type.

Furthermore, protrusions having a predetermined height may be formed at portions facing at least the metal domes in the operation pieces.

Moreover, operation pieces may be supported by arc-shaped connection portions connected to the trapezoidal portions in a cantilever type or in a center impeller type.

According to the present invention, the first spacer having the predetermined thickness is disposed in the first switch portion to form the gap between the upper electrode and the lower electrode, the second spacer having the thickness equal to or greater than the height of the expanded metal domes is disposed in the second switch portion, and the thickness of the second spacer is greater than the first spacer, it is possible to prevent the second switch portion from being turned on although the first switch portion is turned on by the first operation.

In addition, since the upper sheet on which the upper electrode is formed and the lower sheet on which the lower electrode is formed are disposed to face each other through the first spacer, the plurality of through-holes which are defined by the grid-shaped trapezoidal portions and receive the metal domes is formed in the second spacer, and the ridge lines of sides of the trapezoidal portions, on which the lower sheet is mounted, are chamfered or rounded, although the first and second operations are repeatedly performed, it is possible to prevent a crack from being generated in the lower sheet.

Accordingly, it is possible to provide a switch device having a long life span.

Moreover, since the operation pieces which can press the metal domes received in the through-holes are supported in the trapezoidal portions in a cantilever type or in a center impeller type, the operation pieces reasonably drops by the second operation to surely reverse the metal domes and to smoothly turn on the second switch portion. Accordingly, it is possible to provide a switch device having excellent operability.

Furthermore, since the protrusions having a predetermined height are formed at the portions facing at least the metal domes in the operation pieces, it is possible to more surely reverse the metal domes by the protrusions.

Moreover, since the operation pieces are supported by the arc-shaped connection portions connected to the trapezoidal portions in a cantilever type or in a center impeller type, when the second spacer is pressed by the second operation, the operation pieces smoothly drop by the arc-shaped connection portions. Accordingly, it is possible to reasonably reverse the metal domes.

In addition, it is possible to automatically and rapidly return the operation pieces after the operation to an initial state by an elastic release force of the connection portions.

DESCRIPTION OF THE PREFERRED EMBODIMENT

Figure 1:
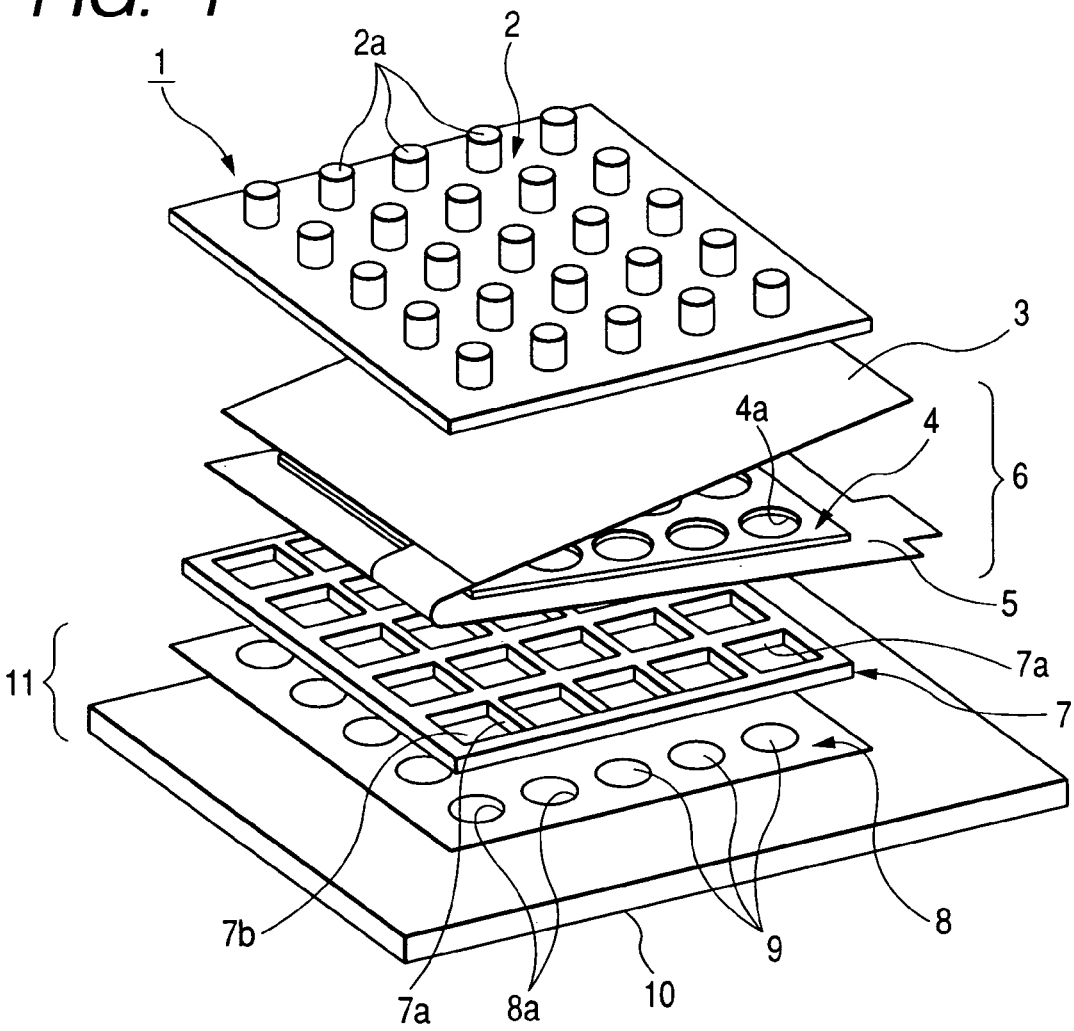
FIG. 1 is an exploded perspective view illustrating a switch device according to the present invention.
Figure 2:
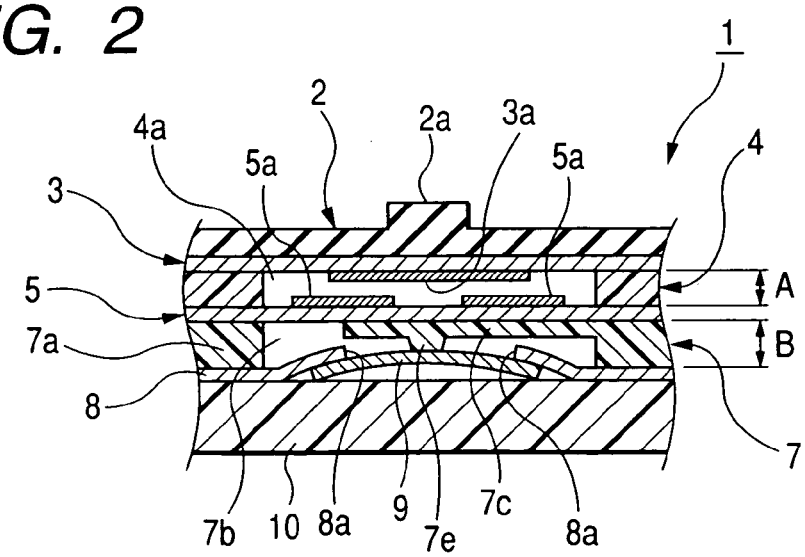
FIG. 2 is a cross-sectional view illustrating main portions of the switch device according to the present invention.
Figure 3:
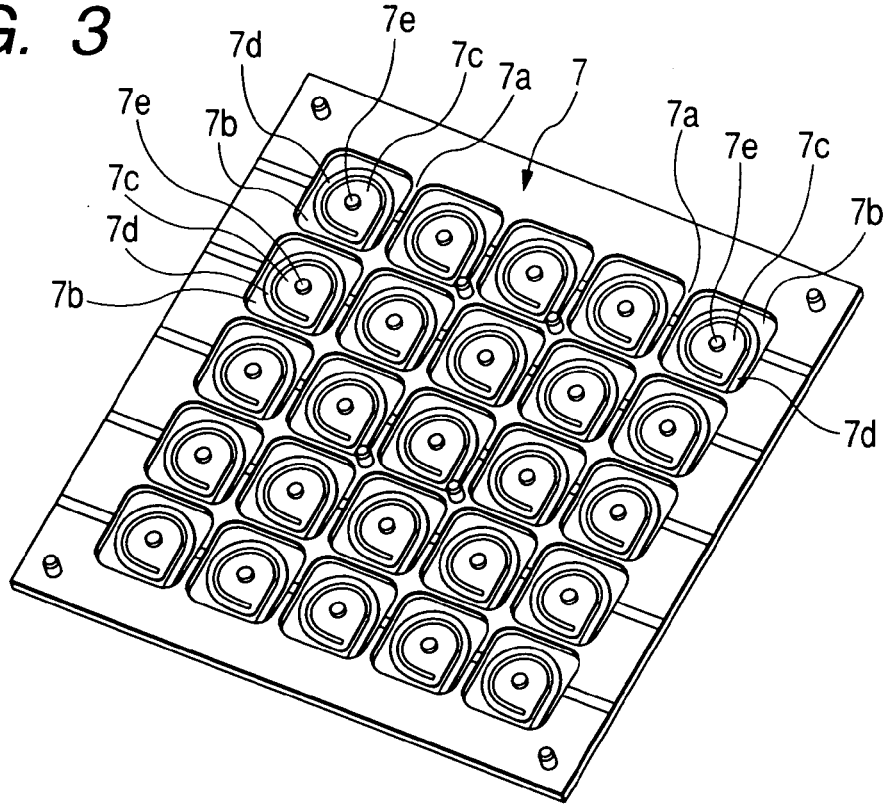
FIG. 3 is a perspective view illustrating a second spacer according to another embodiment of the present invention.
Figure 4:
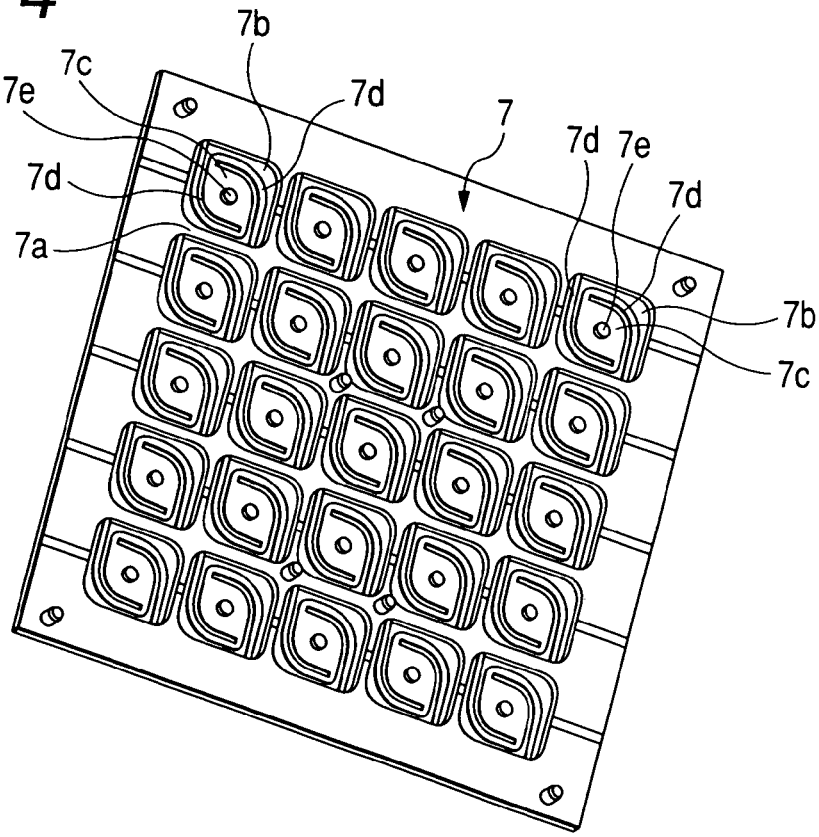
FIG. 4 is a perspective view illustrating a second spacer according to another embodiment of the present invention.
Figure 5:
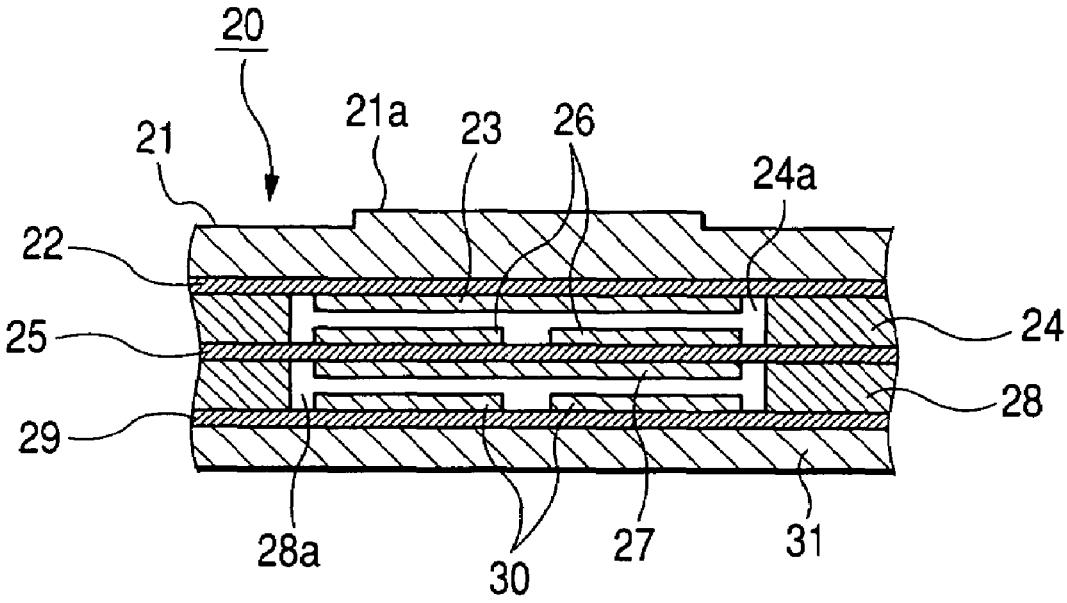
FIG. 5 PRIOR ART
FIG. 5 is a cross-sectional view illustrating main portions of a conventional switch device.

Hereinafter, a switch device according to an embodiment of the present invention will be described with reference to the accompanying drawings. FIG. 1 is an exploded perspective view illustrating a switch device according to the present invention, FIG. 2 is a cross-sectional view illustrating main portions of the switch device according to the present invention, and FIGS. 3 and 4 are perspective views illustrating second spacers according to the other embodiments of the present invention.

A switch device 1 according to the present invention will be described with reference to FIGS. 1 and 2. An elastic cover 2 such as rubber is disposed at an uppermost portion of the switch device 1 according to the present invention and a plurality of operation portions 2*a* which is protruded upward with a predetermined height is formed on the cover 2 with a predetermined pitch.

A flexible upper sheet 3 having a film shape is disposed under the cover 2 and an upper electrode 3*a* having a size less than that of a through-hole 4*a* of a first spacer 4 is formed under the upper sheet 3 by printing.

A first spacer 4 having a thickness A and made of an insulating resin material is disposed under the upper sheet 3 and the thickness A of the first spacer 4 is, for example, 0.15 mm.

A first through-hole 4*a* which has the upper electrode 3*a* and can displace the cover 2 downward is formed in the first spacer 4.

In addition, a flexible lower sheet 5 having a film shape is disposed under the first spacer 4. A pair of lower electrodes 5*a* and 5*a* which are insulated from each other is formed at a portion positioned in the through-hole 4*a* on the lower sheet 5 by printing and the upper electrode 3*a* and the lower electrodes 5*a* and 5*a* are opposed to each other at a predetermined gap.

Moreover, a first switch portion 6 is composed of the upper electrode 3*a* and the lower electrodes 5*a* and 5*a*. The upper electrode 3*a*, which is displaced downward by a first operation for slightly pressing the operation portion 2*a*, comes into contact with the pair of lower electrodes 5*a* and 5*a* to turn on the first switch portion 6.

Furthermore, a second spacer 7 having a thickness B and made of an insulating resin material is disposed under the lower sheet 5 and the thickness B of the second spacer 7 is, for example, 1 mm.

In other words, the thickness B of the second spacer 7 is greater than the thickness A of the first spacer 4. By more thickening the second spacer 7 than the first spacer 4, although the lower sheet 5 is slightly bent downward by the first operation for slightly pressing the operation portion 2*a* and thus a bending force is applied to a metal dome 9, it is possible to prevent the metal dome 9 from being reversed.

In addition, a plurality of through-holes 7*b* defined by grid-shaped trapezoidal portions 7*a* and receiving the metal dome 9 is formed in the second spacer 7.

Ridge lines (corner) of sides of the grid-shaped trapezoidal portions 7*a*, on which the lower sheet 5 is mounted, are chamfered or rounded.

To this end, when the lower sheet 5 is bent into the through-hole 4*a* by a second operation for more strongly pressing the operation portion 2*a* than the first operation, it is possible to prevent a crack from being generated in the lower sheet 5 at the ridge lines of the trapezoidal portions 7*a*.

Furthermore, although the lower sheet 5 is repeatedly bent by the repeated second operation, a crack is not generated in the lower sheet 5 due to fatigue and thus a long life span can be accomplished.

In addition, a dome sheet 8 having a film shape is disposed under the second spacer 7. The metal domes 9 including leaf springs which expand in a dome shape to a predetermined height are attached to the dome sheet 8 using an adhesive at a plurality of positions facing the through-holes 7*b* of the second spacer 7 such that expanded portions are exposed from openings 8*a* of the dome sheet 8 upward.

The height of the expanded metal dome 9 is equal to or less than the thickness B of the second spacer 7.

Moreover, the dome sheet 8 is mounted on a hard printed board 10 with a predetermined thickness and, on the printed board 10, a first fixed contact (not illustrated) having a predetermined shape is formed at portion in which an outer circumferential portion of the metal dome 9 is positioned and a second fixed contact (not illustrated), which is insulated from the first fixed contact, is formed at a portion facing a ceiling surface of an apex of the metal dome 9.

A second switch portion 11 is composed of the metal dome 9 and the first and second fixed contacts.

In addition, in the state that the first switch portion 6 is turned on by the first operation, the lower surface of the lower sheet 5 presses the metal dome 9 by a second operation for more strongly pressing the operation portion 2*a* than the first operation, the metal dome 9 is reversed, and the first and second fixed contacts (not illustrated) are electrically connected to each other, thereby turning on the second switch portion 11.

An operation of the switch device 1 according to the present invention will be described. First, as illustrated in FIG. 2, in an initial state that the first and second switch portions 6 and 11 are in the OFF state, the cover 2 on which the operation portion 2*a* is formed is bent downward by the first operation for slightly touching the operation portion 2*a* using an operator's finger.

Accordingly, the upper electrode 3*a* which is positioned on the through-hole 4*a* of the first spacer 4 is displaced downward and comes into contact with the pair of lower electrodes 5*a* and 5*a*.

In addition, the lower electrodes 5*a* and 5*a* are electrically connected to each other through the upper electrode 3*a* to turn on the first switch portion 6.

Next, after the first operation, the cover 2 in which the through-hole 4*a* of the first spacer 4 is positioned is more bent downward by the second operation for strongly pressing the operation portion 2*a*, compared with the first operation. Accordingly, in the state that the first switch portion is turned on, the lower sheet 5 is pressed and bent downward.

Accordingly, the expanded apex of the metal dome 9 is pressed to the lower surface of the lower sheet 5 to reverse the metal dome 9. By reversing the metal dome 9, the first and second fixed contacts, which are insulated from each other, are electrically connected to each other through the metal dome 9 to turn on the second switch portion 11. In addition, by reversing the metal dome 9, the operator can obtain a click feeling and recognize that the second switch portion 11 is turned on.

For example, by using the switch device 1 according to the present invention in a remote controller of a television, while watching a screen of the television, the touched first switch portion 6 is turned on by the first operation for touching the operation portion 2*a* by a blind touch and a function corresponding to the first switch portion 6 is displayed on the screen of the television.

For example, when the function of the operation portion 2*a* touched by the operator is a channel selection button, a channel number corresponding to the first operation is displayed on the screen of the television.

In addition, when the displayed channel number is a desired number, the second switch portion 11 is turned on by the second operation for more strongly pressing the operation portion 2*a* than the first operation to switch a current channel to the desired channel.

Furthermore, in the embodiment of the present invention, the metal dome 9 received in the through-hole 7*b* of the second spacer 7 directly presses the lower sheet 5. As another embodiment, as illustrated in FIG. 3, an operation piece 7*c* which can press the metal dome 9 received in the through-hole 7*b* is supported by an arc-shaped connection portion 7*d* in a cantilever type, in the trapezoidal portions 7*a* surrounding the through-hole 7*b* in the second spacer 7.

In addition, as illustrated in FIG. 2, the protrusion 7*e* having a predetermined height is formed at a side facing at least the metal dome 9 in the operation piece 7*c*.

When the second spacer 7 is pressed by the second operation, the operation piece 7*c*, which is supported by the connection portion 7*d* formed in the trapezoidal portions 7*a* in the cantilever type, smoothly drops by the arc-shaped connection portion 7*d* and reasonably presses the metal dome 9.

When the second operation is completed and the press of the operation portion 2*a* is released, an elastic release force of the metal dome 9 and an elastic release force of the connection portion 7*d* are applied to push the first switch portion 6 upward, thereby automatically returning to the initial state at a high speed.

In addition, it is possible to surely press the apex of the metal dome 9 by the protrusion 7*e* and to smoothly reverse the metal dome 9.

Moreover, the operation piece 7*c* may be supported by two connection portions 7*d* and 7*d* configuring the trapezoidal portions 7*a*, as illustrated in FIG. 4.

By supporting the operation piece 7*c* using the two connection portions 7*d* and 7*d* in a center impeller type, it is possible to automatically return the operation piece 7*c* to the initial state at a higher speed.

What is claimed is:

1. A switch device comprising a first switch portion in which an upper electrode and a lower electrode face each other at a predetermined gap and a second switch portion having metal domes which are disposed at a lower side facing the first switch portion and expand to a predetermined height, wherein a first spacer having a predetermined thickness is disposed in the first switch portion to form a gap between the upper electrode and the lower electrode, a second spacer having a thickness equal to or greater than the expanded height of the metal domes is disposed in the second switch portion, and the thickness of the second spacer is greater than that of the first spacer.

2. The switch device according to claim 1, wherein an upper sheet on which the upper electrode is formed and a lower sheet on which the lower electrode is formed are disposed to face each other through the first spacer, a plurality of through-holes which are defined by grid-shaped trapezoidal portions and receive the metal domes is formed in the second spacer, and ridge lines of sides of the trapezoidal portions, on which the lower sheet is mounted, are chamfered or rounded.

3. The switch device according to claim 2, wherein operation pieces which can press the metal domes received in the through-holes are supported in the trapezoidal portions in a cantilever type or in a center impeller type.

4. The switch device according to claim 3, wherein protrusions having a predetermined height are formed at portions facing at least the metal domes in the operation pieces.

5. The switch device according to claim 3, wherein operation pieces are supported by arc-shaped connection portions connected to the trapezoidal portions in a cantilever type or in a center impeller type.

* * * * *